US006327372B1

(12) United States Patent
Devantier et al.

(10) Patent No.: US 6,327,372 B1
(45) Date of Patent: Dec. 4, 2001

(54) CERAMIC METAL MATRIX DIAPHRAGM FOR LOUDSPEAKERS

(75) Inventors: Allan O. Devantier, Canyon Country; An D. Nguyen, West Hills, both of CA (US)

(73) Assignee: Harman International Industries Incorporated, Northridge, CA (US)

( * ) Notice: Subject to any disclaimer, the term of this patent is extended or adjusted under 35 U.S.C. 154(b) by 0 days.

(21) Appl. No.: 09/226,087

(22) Filed: Jan. 5, 1999

(51) Int. Cl.[7] ..... H04R 25/00

(52) U.S. Cl. ..... 381/426; 381/427; 181/167; 181/168

(58) Field of Search ..... 181/167, 168, 181/170, 171, 172, 174, 169; 381/398, 423, 424, 426, 427, FOR 162, FOR 164

(56) References Cited

U.S. PATENT DOCUMENTS 3,366,748 * 1/1968 Ashworth .
3,710,040 * 1/1973 Swinehart .
4,352,961 * 10/1982 Kumada et al. .
4,410,768 * 10/1983 Nakamura et al. .
4,431,873 * 2/1984 Dunn et al. .
5,135,582 * 8/1992 Mochazuki et al. ..... 181/168

OTHER PUBLICATIONS

"Monitor Audio Studio 10", Hi–Fi Answers, Mar. 1990.
"Aluminum Electronic Enclosures and Ceramic Components", Circle Designfax Cards Nos. 134 and135, dated Apr. 1993.
"Ti–Aluminide Blades Tested in GE Engine", Aviation Week & Space Technology, p. 37, Nov. 29, 1993.
"1994 Materials Selector Issue", Machine Design, a Penton Publication, Dec. 1993 pp. 10–13.
"Inside Metal–Cone Speakers", AudioVideo International, pp. 24, 26, 28, 30, Nov. 1997.

* cited by examiner

*Primary Examiner*—Sinh Tran
*Assistant Examiner*—T. Dabney
(74) *Attorney, Agent, or Firm*—Squire, Sanders & Dempsey

(57) ABSTRACT

A speaker diaphragm for a loudspeaker that has a composite material formed of two layers of ceramic material separated by a light metal substrate with the percentage ratio of the thickness of the ceramic layers to the light metal substrate being in the range of from about 10% to 45% for each ceramic layer and a corresponding 80% to 10% for the lightweight metal substrate.

13 Claims, 6 Drawing Sheets

CERAMIC METAL MATRIX DIAPHRAGM FOR LOUDSPEAKERS

BACKGROUND OF THE INVENTION

1. Field of the Invention

The present invention relates in general to loudspeakers and in particular to a diaphragm for a loudspeaker that significantly improves the quality of sound and the usable life of the loudspeaker.

2. Description of Related Art Including Information Disclosed Under 37CFR 1.97and 1.98

A typical loudspeaker transducer 10 , as shown in FIG. 1, has a cone 12 and/or dome 14 , diaphragm that is driven by a voice coil 16 that is immersed in a strong magnetic field. The voice coil 16 is electrically connected to an amplifier and, when in operation, the voice coil 16 moves back and forth in response to the electromagnetic forces on the coil caused by the current in the coil, generated by the amplifier, and the stationary magnetic field. The cone 12 and voice coil 16 assembly is typically suspended by a "spider" 18 and a "surround" 13 , a flexible connector to frame 20. This suspension system allows the cone and coil assembly to move as a finite excursion piston over a limited frequency range. Like all mechanical structures, cones and domes have natural modes or "Mode peaks" commonly called "cone break-up". The frequency at which these modes occur is largely determined by the stiffness, density, and dimensions of the diaphragm, and the amplitude of these modes is largely determined by internal damping of the diaphragm material. These mode peaks are a significant source of audible coloration and, as a result, degrade the performance of the loudspeaker system.

Designers have tended to take two paths to solve the cone break-up problem. For small diaphragms such as those found in dome tweeters, aluminum and titanium are commonly used. In these applications, the dome dimensions can be manipulated such that the first natural modes of the dome are above the frequency range of human hearing. FIG. 2 shows the frequency response of a typical 1" titanium dome tweeter (note the large mode peak 22 at 25 kHz). The amplitude of these modes is usually very high because metals have very little internal damping. For diaphragms larger than approximately 1", the dome modes fall into the audible range. These modes are plainly audible as coloration because of the high amplitude of the modes. FIG. 3 shows the frequency response of a typical 3" titanium dome mid-range speaker (note several large peaks 24, 26, and 28 at 11 kHz, 16 KHz, and 18 kHz).

For larger diaphragms, softer materials such as polymers or papers are commonly used. These materials have several natural modes in the band in which they operate. However, the internal damping of these materials is high enough so that most of these modes do not cause audible coloration. The remaining modes are either compensated for in other parts of the loudspeaker system design, resulting in increased costs, or are not addressed at all, resulting in lower performance. FIG. 4 shows the frequency response of a typical 5" woofer with a polypropylene cone (note the large mode peaks 30 and 32 at 4 kHz and 5 kHz).

Many metal diaphragms feature a thin anodized layer. Typically, the metal is anodized to provide a specific color to the visible surface, or to protect the metal from sunlight, humidity, or moisture.

Ceramic materials such as alumina or magnesia offer significantly higher stiffness numbers and slightly better internal losses than typical metals such as titanium or aluminum. As a result, the natural modes of diaphragms made of these materials are moved higher in frequency and reduced in amplitude and, thus, reduce audible coloration. For instance, FIG. 14 shows the frequency response of a 5" woofer with a ceramic metal matrix cone of the present invention. Note that the mode peaks 34 and 36 occur at approximately 6.5 kHz and 8.5 kHz. Compare FIG. 14 to FIG. 4. The mode peaks 34 and 36 have moved to a significantly higher frequency than mode peaks 30 and 32 in FIG. 4. This frequency extension allows a more simple and economical roll-off circuit, well known in the art, to be constructed to eliminate the unwanted frequencies.

Table I shows the important structural parameters for several materials. Unfortunately, pure ceramics are very brittle and are prone to shattering when used as loudspeaker diaphragms. Additionally, making diaphragms of appropriate dimensions can be very expensive. As a result, pure ceramic loudspeaker diaphragms have not become common.

TABLE I

PROPERTIES OF DIAPHRAGM MATERIALS

| Material | Young's Modulus (Stiffness) | Density | Speed of Sound | Internal Loss (damping) |
|---|---|---|---|---|
| Paper | $4 \times 10^9$ Pa | 0.4 g/cm$^3$ | 1000 m/sec | 0.06 |
| Polypropylene | $1.5 \times 10^9$ Pa | 0.9 g/cm$^3$ | 1300 m/sec | 0.08 |
| Titanium | $110 \times 10^9$ Pa | 4.5 g/cm$^3$ | 4900 m/sec | 0.003 |
| Aluminum | $70 \times 10^9$ Pa | 2.7 g/cm$^3$ | 5100 m/sec | 0.003 |
| Alumina | $340 \times 10^9$ Pa | 3.8 g/cm$^3$ | 9400 m/sec | 0.004 |

SUMMARY OF THE INVENTION

Thus, the present invention relates to a material that is formed of a matrix, or layers, of a light metal such as aluminum, sandwiched between two ceramic layers, preferably aluminum oxide ($Al_2O_3$). The material is particularly useful as a loudspeaker diaphragm. The ceramics, $Al_2O_3$, are generally stiffer than metals and also offer improved damping. A loudspeaker diaphragm made of aluminum oxide would offer performance superior to any of the known materials today. Unfortunately, ceramics are also very brittle, and a diaphragm made of pure aluminum oxide would "shatter itself to bits" under normal loudspeaker operations.

Thus, the material of the present invention is made of two layers of ceramic separated by a light metal substrate. Of the common metals, aluminum has the lowest density, making it the ideal substrate. However, there is no known reason why other metals, such as copper, titanium, and the like should not have the same advantages as the use of aluminum.

A skin of alumina, or ceramic, is formed by well-known means, such as anodizing and/or being "grown", on each side of the aluminum core or substrate. Anodizing provides a molecular bond instead of a chemical bond between the substrate and the ceramic material. The alumina thus supplies the strength and the aluminum substrate supplies the resistance to shattering. It has high internal frequency losses. The resulting composite material is less dense and less brittle than traditional ceramics, yet is significantly stiffer, and has better damping than titanium. It also resists moisture and sunlight better than any polymer and is at least as good as other metals for providing such resistance.

Thus, it is an object of the present invention to provide a loudspeaker diaphragm formed of composite material.

It is also an object of the present invention to provide a loudspeaker diaphragm composite material that is less dense and less brittle than traditional ceramics, yet it is significantly stiffer and has better damping than titanium.

It is a further object to the present invention to provide a loudspeaker diaphragm that resists moisture and sunlight to a greater degree than any polymer or most metal diaphragms.

It is still another object of the present invention to provide a loudspeaker diaphragm material that is a composite source of two layers of ceramic material separated by a light metal substrate.

It is yet another object of the present invention to provide a composite material formed of two layers of ceramic materials separated by a light metal substrate in which the percentage ratio of the thickness of the ceramic layers and the light metal substrate is in the range from about 10% to 45% for each ceramic layer and a corresponding 80% to 10% for the lightweight metal substrate.

It is still another object to the present invention to provide a speaker diaphragm formed of a layer of light metal, or substrate, having an oxide layer on each side and wherein the preferred percentage ratio of ceramic layers to the light metal substrate core is 33⅓%, 33⅓%, and 33⅓%.

It is also an object of the present invention to provide a speaker diaphragm formed of a composite material such as two layers of ceramic material separated by a light metal substrate.

It is also an object of the present invention to provide a material wherein two layers of ceramic material are separated by a light metal substrate, such as aluminum, and wherein the ceramic layers are formed of $Al_2O_3$.

Thus, the present invention relates to a speaker diaphragm for a loudspeaker comprising a composite material formed of two layers of ceramic material separated by a light metal substrate, and the percentage ratio of the thickness of the ceramic layers and the light metal substrate being in the range of from about 10% to 45% for each ceramic layer and about a corresponding 80% to 10% for the lightweight metal substrate.

The invention also relates to a composite material for loudspeaker cones and domes for extending the frequency range natural modes, or cone "break-up" modes, and is formed of two layers of ceramic material separated by a light metal substrate, the ceramic material and the light metal substrate being of respective thicknesses to provide rigidity to the composite material without shattering and to increase the extended frequency range of the loudspeakers.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 5:
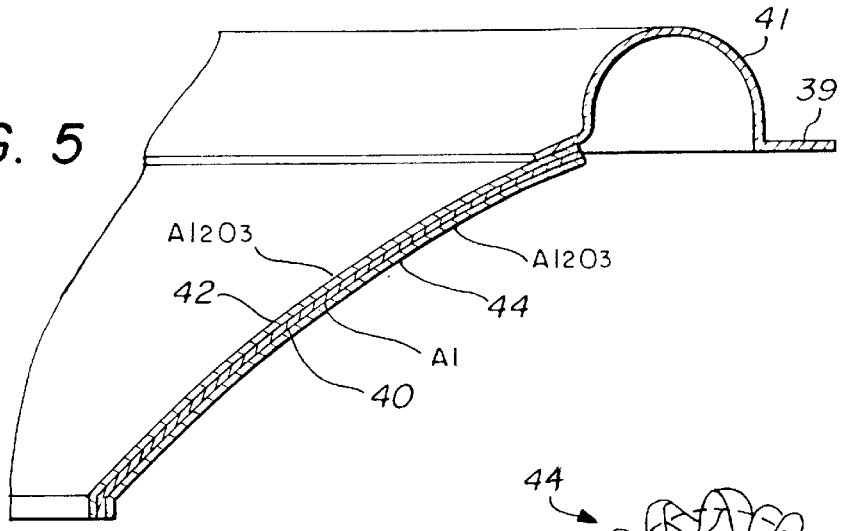
FIG. 5 is a partial cross-sectional view of the present invention applied to a 4" mid-range cone.

The invention shown in FIG. 5 can be described as a composite diaphragm 38 composed of a metal core, or substrate 40 , with a layer of ceramic material 42 and 44 on either side in appropriate proportions, so as to minimize both cone break-up (extend the frequency range) and brittleness. FIG. 5 shows the invention in partial cross section as applied to a 4" mid-range cone. In this example a cone of 3 mm thickness is composed of a substrate of aluminum of 1 mm thickness and two layers of alumina, each 1 mm thick, one on each side of the core 40.

Figure 6:
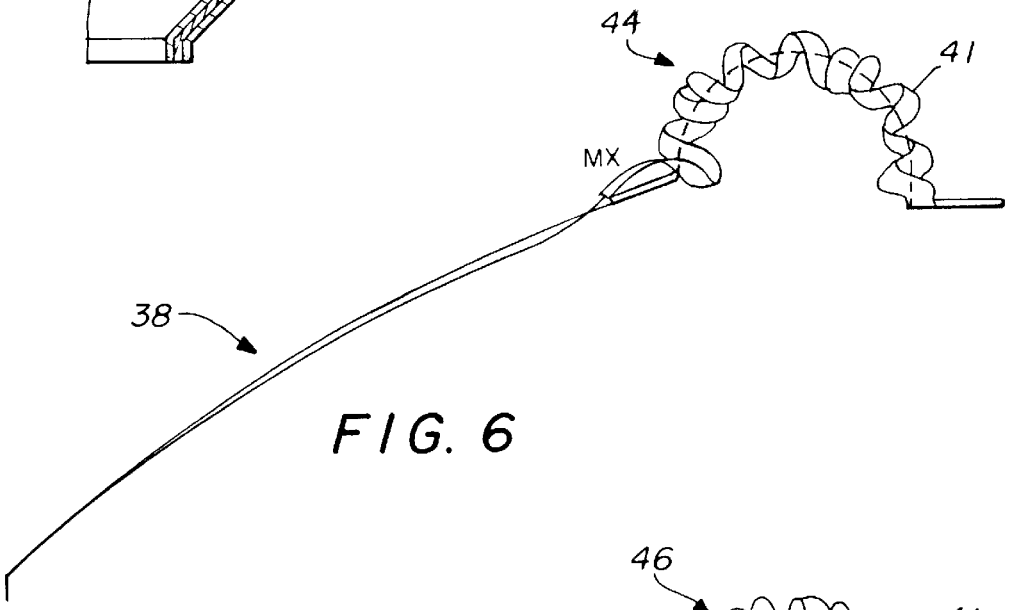
FIG. 6 illustrates the Finite Element Analysis (FEA) of a typical 4" mid-range cone constructed of aluminum.
Figure 7:
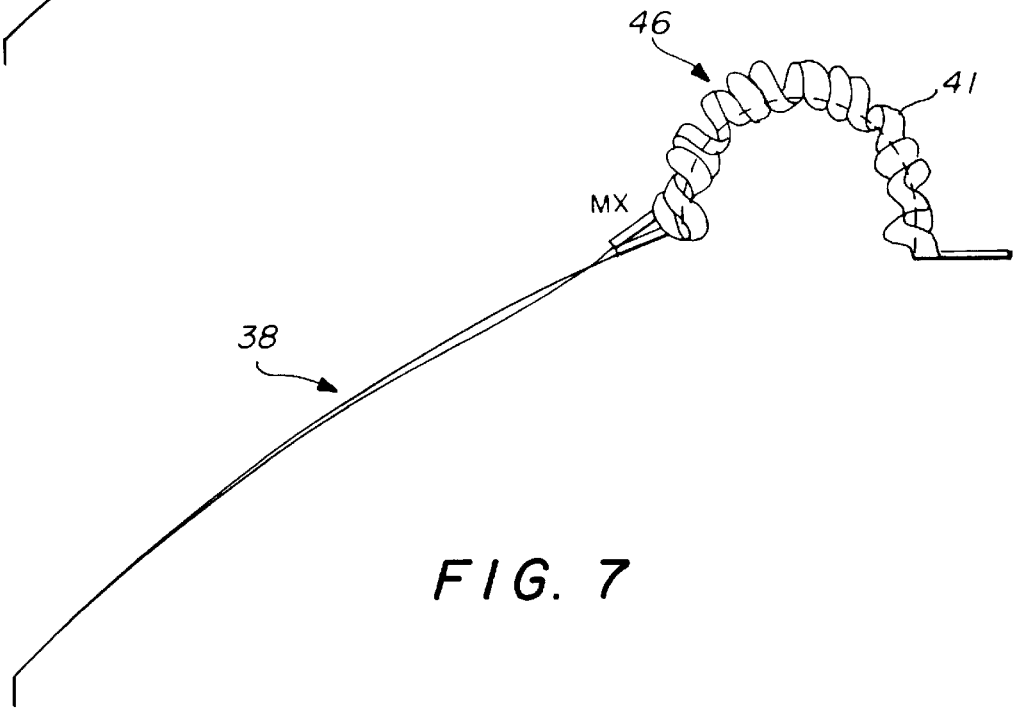
FIG. 7 shows the FEA of the same cone constructed according to the present invention.
Figure 8:
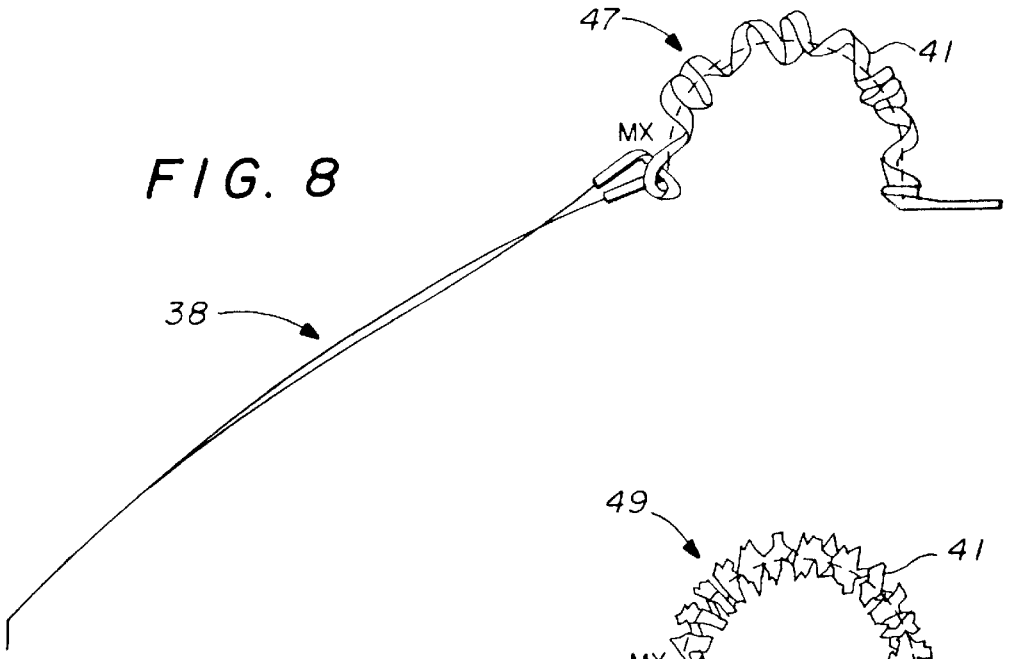
FIG. 8 shows the FEA of a cone of the present invention having an aluminum substrate that represents 80% of the total cone thickness.
Figure 9:
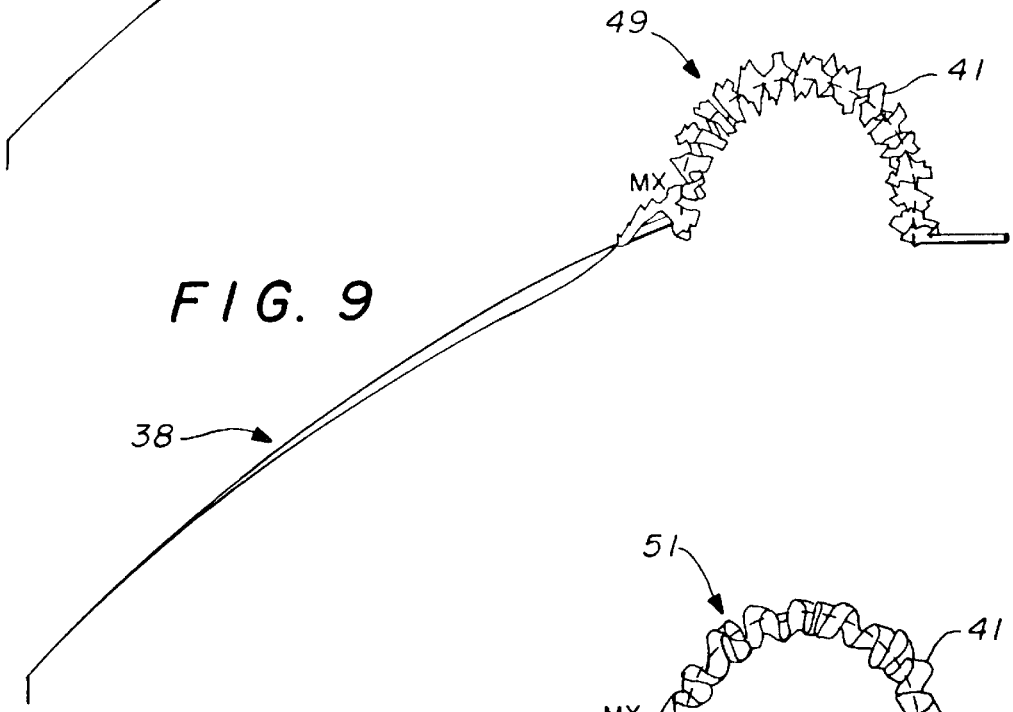
FIG. 9 shows the FEA of a cone of the present invention having an aluminum substrate that represents 20% of the total cone thickness.
Figure 10:
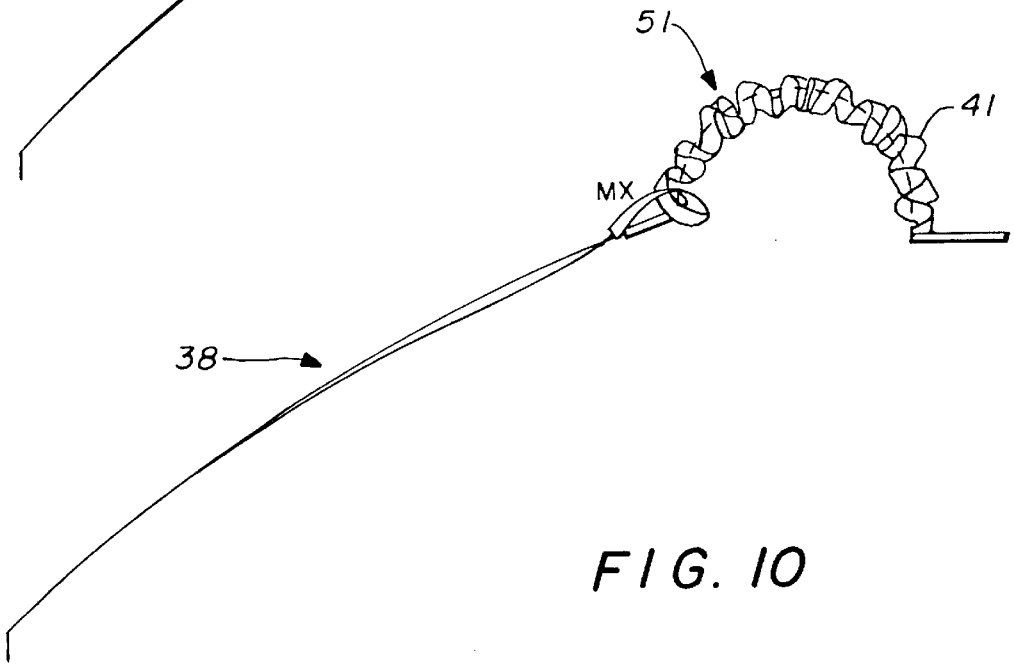
FIG. 10 shows the FEA of a cone of the present invention having an aluminum substrate made of solid ceramic.

The diaphragm 38 is coupled to frame 39 through flexible connector 41 and can be composed of any metal substrate and any ceramic skin. Prior art anodized aluminum cones, which are common, fall into this class. These diaphragms of the prior art are typically 3 mm thick with a 2.6 mm thick substrate of aluminum and two 0.2 mm thick layers of alumina, one on each side of the substrate. In this prior art case, the metal substrate represents approximately 87% of the total thickness of the cone. FIG. 6 shows the Finite Element Analysis of a typical 4" mid-range cone 38 constructed solely of aluminum. The first natural mode peak 44 of the cone distorts the flexible connector 41 and occurs at 8 kHz. FIG. 7 shows the FEA of the same cone constructed in accordance with the present invention while using a 1 mm aluminum substrate and two 1 mm layers of alumina, one on each side. The first natural mode 46 of this cone moves all the way to 15 kHz from the 8 kHz of the cone of FIG. 6. In other words, the cone "break-up" occurs at 15 kHz with the present invention as compared to cone "break-up" at 8 kHz of the same prior art speaker. FIGS. 8 and 9 show the FEA of cones of the present invention with aluminum substrates that represent 80% of the total thickness (FIG. 8) and aluminum substrates that represent 20% of the total thickness (FIG. 9), respectively. As can be seen in Table II, such cone with 80% aluminum substrate has a first "break-up" mode 47 at 12.4 kHz while a cone with 20% aluminum substrate has a first "break-up" mode 49 at 15.95 kHz. For reference, the FEA of a solid ceramic cone is also included as FIG. 10 where the first "break-up" mode 51 occurs at 16 kHz. The optimum thickness for the aluminum substrate of the present invention ranges from 20% to 80% of the total thickness of the diaphragm. For transducer applications, typical thickness of the diaphragm of the present invention ranges from 1 mm to 25 mm thickness. As stated, Table II shows the FEA results of various percentages of alumina to the total thickness of the cone from 100% aluminum to 100% alumina.

TABLE II

| Material Type | Frequency of the cone's first bending mode | Frequency of the cone's first significant break-up mode | Frequency of the cone's second significant break-up mode | Frequency of the cone's third significant break-up mode |
|---|---|---|---|---|
| 100% Aluminum | 6902 Hz | 8410 Hz | 11009 Hz | 12778 Hz |
| 10% Alumina/ 80% Aluminum/ 10% Alumina | 7840 Hz | 12400 Hz | 15060 Hz | 17340 Hz |
| 33% Alumina/ 33% Aluminum/ 33% Alumina | 9930 Hz | 15060 Hz | 17910 Hz | 19050 Hz |
| 40% Alumina/ 20% Aluminum/ 40% Alumina | 10100 Hz | 15950 Hz | 18500 Hz | Above 20000 Hz |
| 100% Alumina | 11010 Hz | 16010 Hz | 19050 Hz | Above 20000 Hz |

Figure 1:
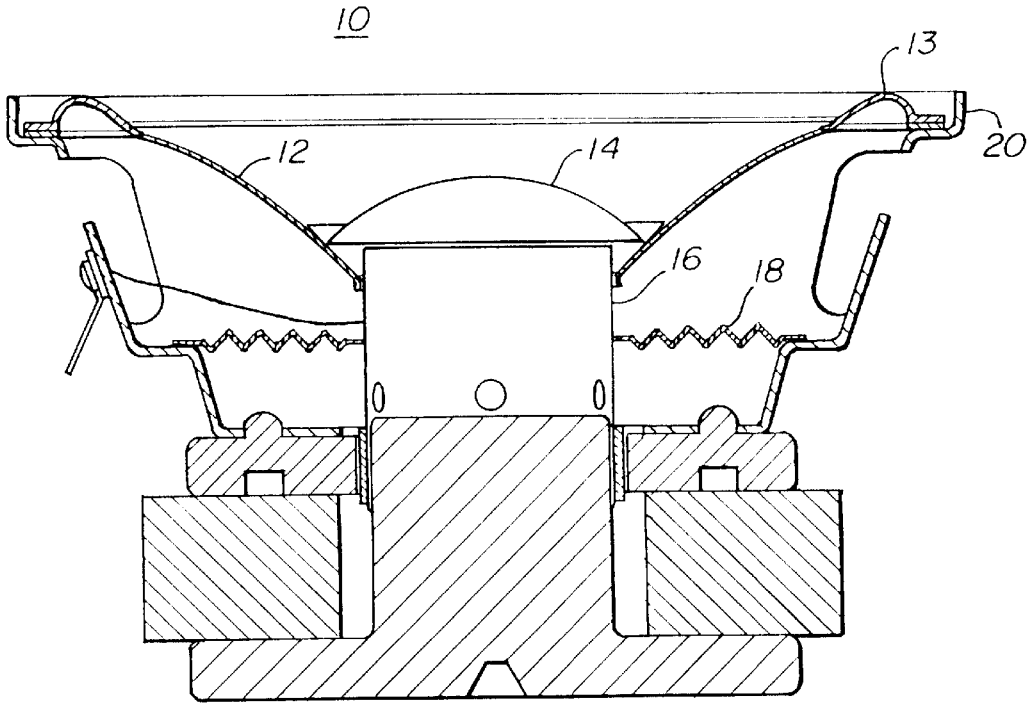
FIG. 1 is a cross-sectional view of a typical loudspeaker transducer.
Figure 2:
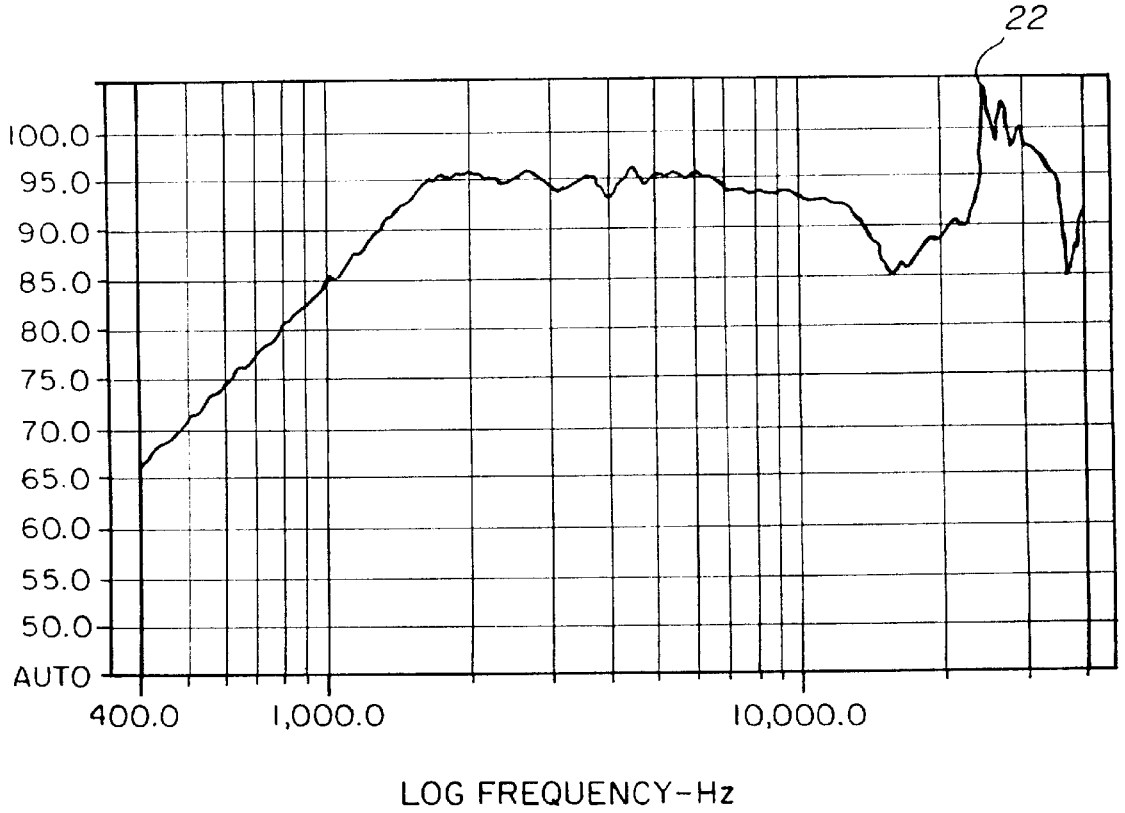
FIG. 2 illustrates the frequency response of a typical 1" titanium dome tweeter.
Figure 3:
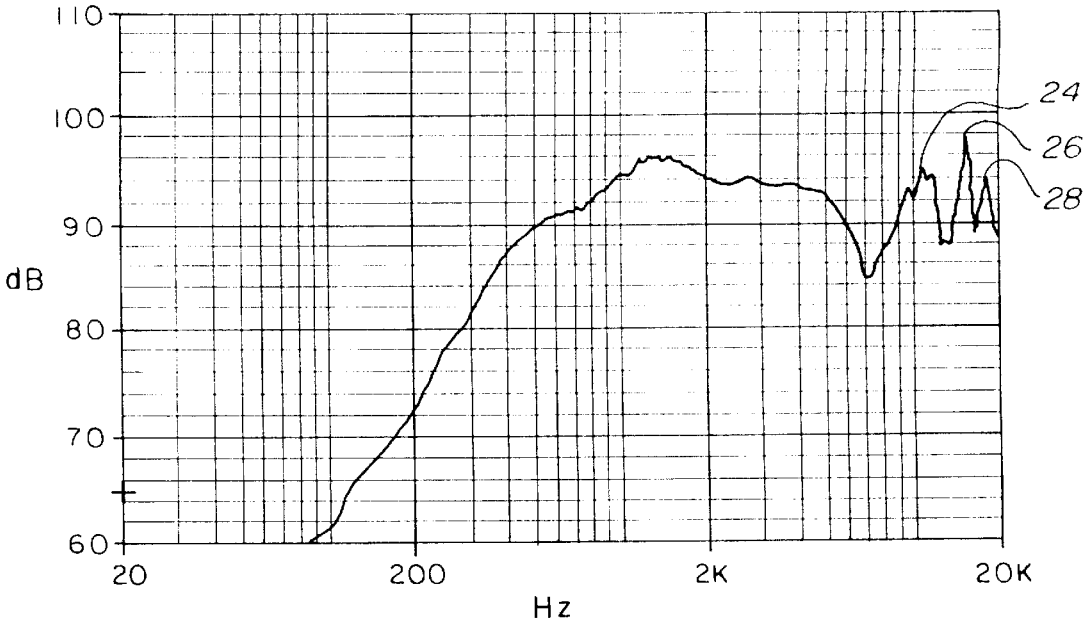
FIG. 3 illustrates the frequency response of a typical 3" titanium dome, mid-range speaker.
Figure 4:
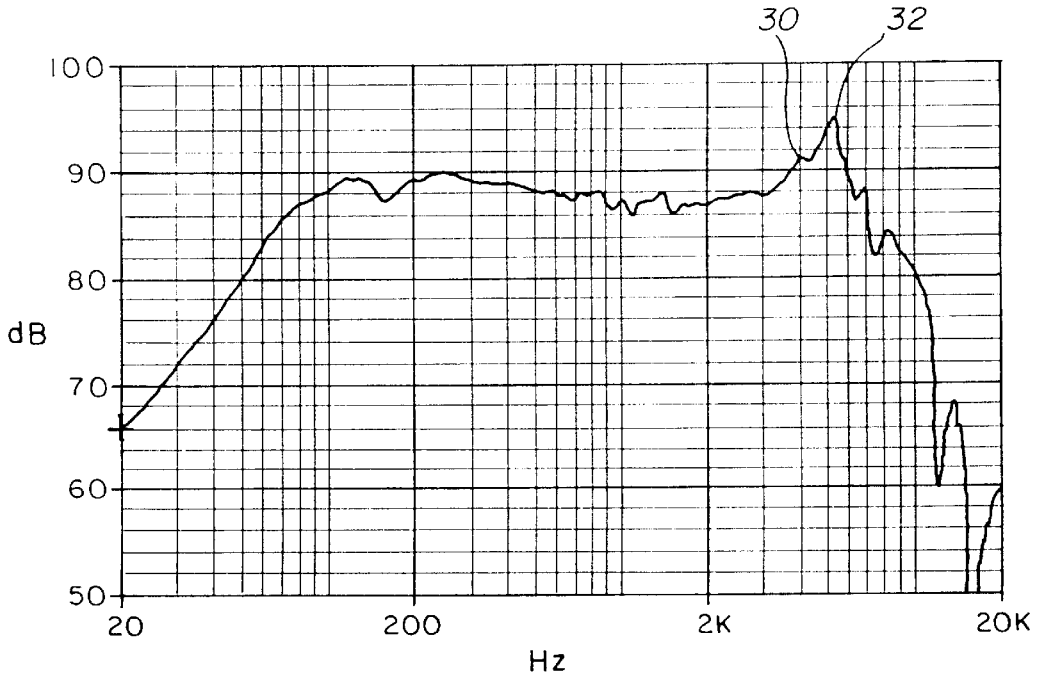
FIG. 4 illustrates the frequency response of a typical 5" woofer with a polypropylene cone.

As stated earlier, FIG. 2 shows a graph of the frequency response of a 1" dome tweeter with a traditional titanium diaphragm. The graph shows that the first resonant peak 22 occurs at 25 kHz.

Figure 11:
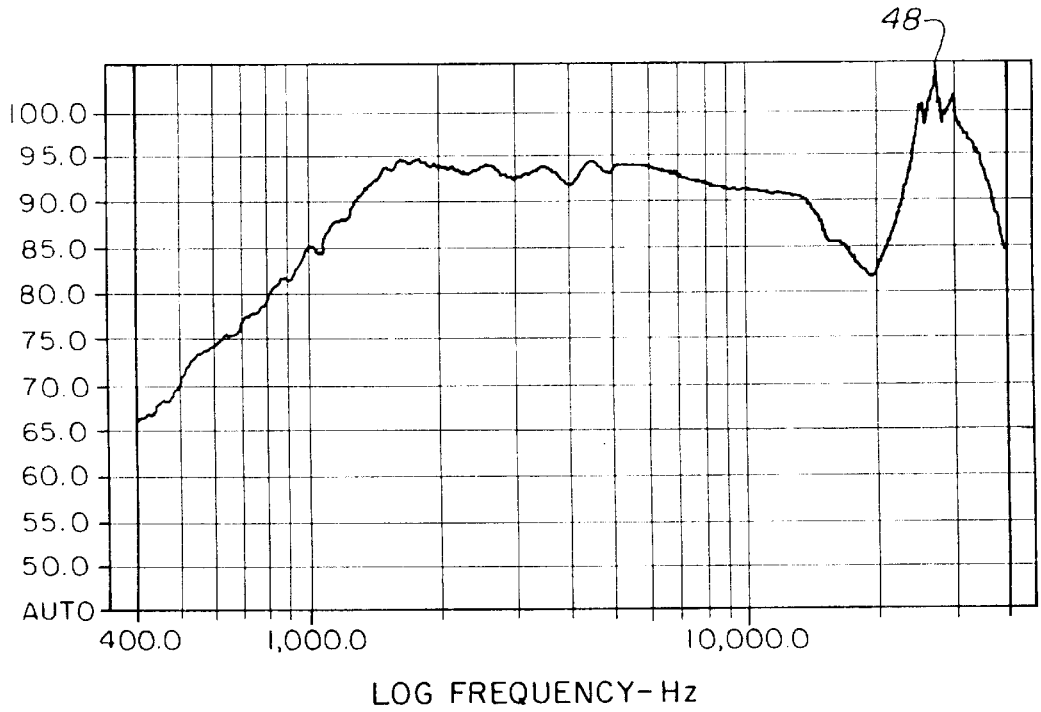
FIG. 11 shows the FEA of a 1" dome tweeter as shown in FIG. 2 except with a ceramic metal matrix dome of the present invention.

FIG. 11 shows the frequency response of the same basic tweeter of FIG. 2 except with a ceramic metal matrix dome of the present invention. On this tweeter the first resonant peak 48 has been moved up to 28 kHz.

Figure 12:
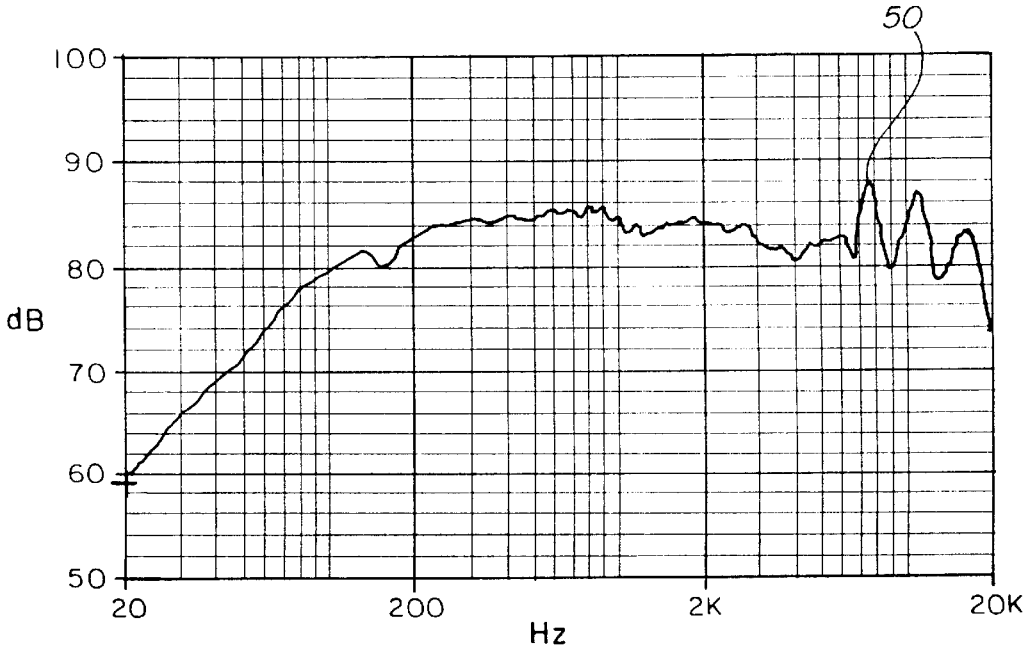
FIG. 12 shows the frequency response of a 4" mid-range speaker with a traditional aluminum cone.
Figure 13:
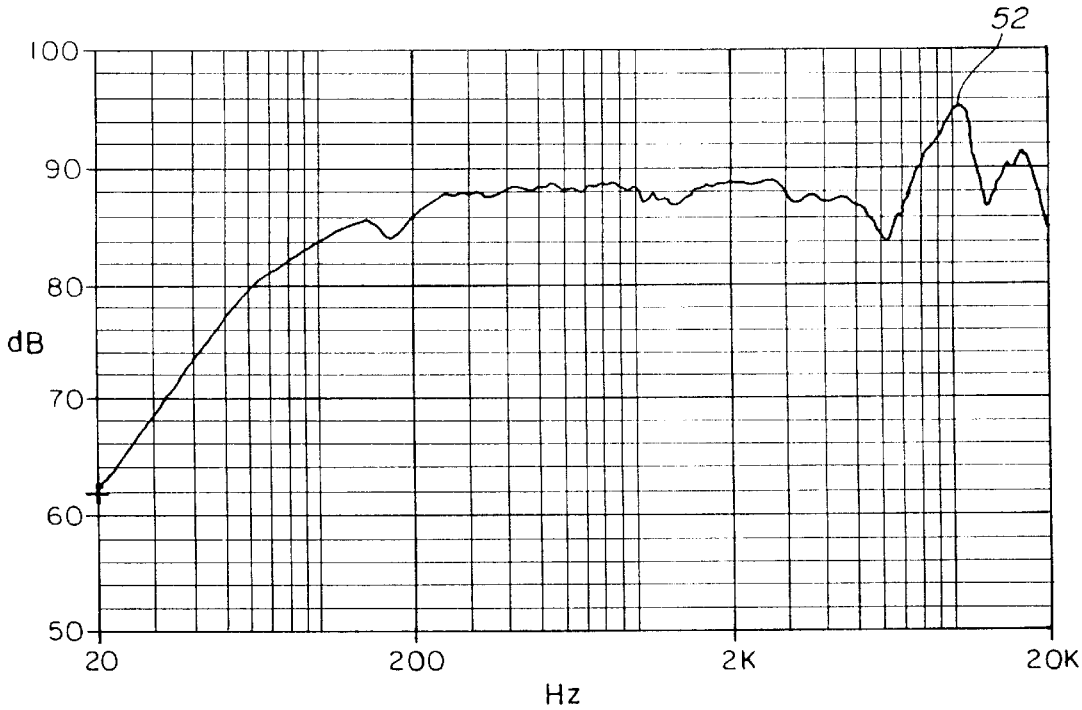
FIG. 13 shows the frequency response of the same 4" mid-range speaker in FIG. 12 with a ceramic metal matrix cone of the present invention.

FIG. 12 shows the frequency response of a 4" mid-range loudspeaker with a traditional aluminum cone. The graph shows the first resonant peak 50 occurs at 8 kHz. FIG. 13 shows the frequency response of the same basic mid-range loudspeaker except with the ceramic metal matrix cone of the present invention. With this mid-range speaker, the first resonant peak 52 has been moved up to 11 kHz as compared to the 8 kHz frequency of the traditional aluminum cone as shown in FIG. 8.

Figure 14:
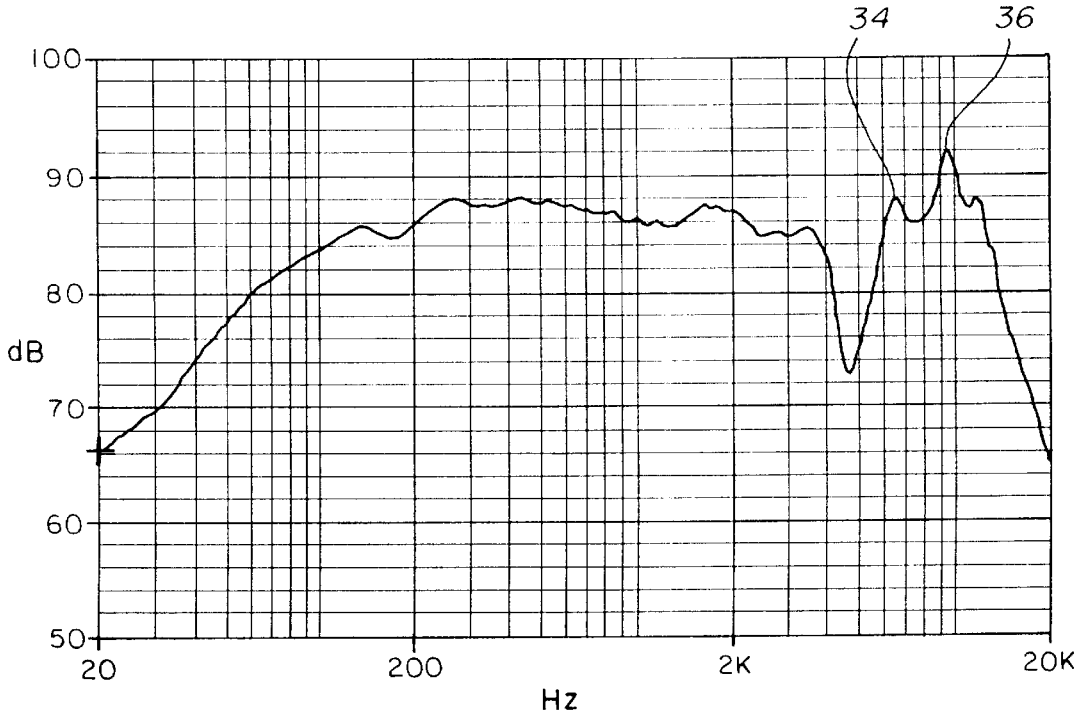
FIG. 14 shows the frequency response of the 5" woofer of FIG. 4 formed with the ceramic metal matrix cone of the present invention.

The graph of FIG. 14, representing a speaker formed with the novel inventive composite material, has been compared earlier with the graph of FIG. 2 for the same traditional speaker.

A 4" mid-range speaker will be used as an example of how to make a ceramic metal matrix diaphragm. The basic shape of the diaphragm is shown in FIG. 5 and is formed of 2 mm thick aluminum using standard metal forming techniques. The diaphragm is then deep anodized in a well-known manner. In the preferred example, 0.5 mm of aluminapenetrates into the aluminum and 0.5 mm of alumina is "grown" on the surface of the aluminum on each side, again in a well-known manner. The resulting cone is approximately 3 mm thick with a 1 mm thick aluminum substrate and 1 mm layer of alumina on each side.

These ceramic metal matrix diaphragms offer several advantages over the existing technology. One advantage is enabling the use of low cost, simple "roll-off" circuits to eliminate or reduce the audibility of the mode peaks.

Advantages compared to polymers, papers, and other "soft" diaphragms:

Significantly higher stiffness to weight ratio.

More consistent performance over a wide range of temperature and humidity. For example, polypropylene's performance changes dramatically with temperature, while paper can be significantly affected by humidity.

Superior immunity to UV light and sunlight.

Superior immunity to water and salt water.

Superior immunity to combustibility.

Advantages compared to aluminum and titanium:

Significantly higher stiffness to weight ratio.

Higher internal damping.

Superior immunity to UV light and sunlight.

Superior immunity to water and salt water.

Offers more color options.

Advantages compared to pure ceramics:

Significantly better resistance to shattering (i.e., less brittle).

Tighter control critical dimensions, including the ability to make very thin walls.

The corresponding structures, materials, acts, and equivalents of all means or step plus function elements in the claims below are intended to include any structure, material, or act for performing the function in combination with other claimed elements as specifically claimed.

What is claimed is:

1. A speaker diaphragm for a loudspeaker comprising:

a composite material having an overall thickness of about 3 mils and formed of two layers of ceramic material separated by a light metal substrate to form a speaker diaphragm; and the thickness of the ceramic layers and the light metal substrate having a percentage ratio in the range of from about 10% to 45% for each ceramic layer and a corresponding 80% to 10% for the lightweight metal substrate.

2. The speaker diaphragm of claim 1 wherein the preferred percentage ratio of the ceramic layers to the light metal substrate is 33⅓%, 33⅓%, and 33⅓%.

3. The speaker diaphragm of claim 1 wherein the light metal substrate is preferably formed of aluminum.

4. The speaker diaphragm of claim 3 wherein the ceramic layers are formed of aluminum oxide.

5. A method of forming a speaker diaphragm for a loudspeaker having an overall thickness of about 3 mils comprising the steps of:

forming a speaker diaphragm having a composite material of two layers of ceramic material separated by a light metal substrate; and forming the thickness of the ceramic layers and the light metal substrate having a percentage ratio in the range of from about 10% to 45% for each ceramic layer and a corresponding 80% to 10% for the lightweight metal substrate.

6. The method of claim 5 further including the step of forming a preferred thickness ratio of the ceramic layer to the lightweight metal substrate of 33⅓%, 33⅓%, and 33⅓%, respectively.

7. The method of claim 5 further including the steps of:

forming the light metal substrate of aluminum; and forming the ceramic layers of aluminum oxide.

8. The method of claim 5 further including the steps of:

forming the thickness of said substrate of 1 mil; and forming the thickness of each said ceramic layer of 1 mil thus forming said composite material of 3 mils thickness.

9. The method of forming said speaker diaphragm of claim 5 wherein said step of forming a composite material further comprises the steps of:

providing an aluminum substrate having two surfaces and a thickness of about 2 mils between said two surfaces; and forming said two layers of ceramic material by anodizing said two surfaces of said aluminum substrate.

10. The method of claim 9 wherein said step of forming comprises anodizing each of said two surfaces of said aluminum substrate to a depth of about ½ mil thereby leaving 1 mil of aluminum and two anodized aluminum layers of about 1 mil each for an overall thickness of about 3 mils.

11. A composite material for loudspeaker cones and domes for extending the frequency range of natural modes of the loudspeaker comprising:

two layers of ceramic material separated by a light metal substrate; and the ceramic material and the light metal layers being of respective thicknesses to provide rigidity to the composite material without shattering and to increase the extended frequency range of said natural modes of the loudspeaker;

wherein each said layer of ceramic material and said light metal substrate have the same thickness.

12. A method of manufacturing a speaker diaphragm for a loudspeaker comprising the steps of:

providing an aluminum speaker diaphragm with an inside and outside surface and having a thickness of about 2 mils between said inside and outside surfaces;

anodizing both of said inside and outside surfaces of said aluminum speaker diaphragm to form a composite material of two layers of aluminum oxide separated by an aluminum layer; and forming the thickness of the aluminum oxide layers and the aluminum layer to have a percentage ratio in the range of about 10% to 45% for each aluminum oxide layer and a corresponding 80% to 10% for the aluminum layer.

13. The method of claim 12 wherein said forming step includes forming a preferred thickness ratio of aluminum oxide layers to the aluminum layer of about 33⅓, 33⅓, and 33⅓, respectively.

* * * * *